United States Patent [19]

Mouat

[11] 3,964,183

[45] June 22, 1976

[54] METHOD AND APPARATUS FOR DETACHING COATINGS FROZEN ON TO SURFACES

[75] Inventor: Thomas W. Mouat, Vancouver, Canada

[73] Assignee: B. C. Research, Canada

[22] Filed: June 4, 1974

[21] Appl. No.: 476,200

Related U.S. Application Data

[63] Continuation of Ser. No. 321,721, Jan. 8, 1973, abandoned.

[52] U.S. Cl. ..... 37/12; 404/77; 404/79; 404/95; 37/195; 219/220

[51] Int. Cl.[2] ..... E01H 5/10; E01C 23/14

[58] Field of Search ..... 37/11, 12, 195; 219/200, 201, 202, 203, 220, 354; 126/271.1, 271.2 R; 404/77, 79, 95; 432/13, 31

[56] References Cited

UNITED STATES PATENTS

| | | | |
|---|---|---|---|
| 2,259,120 | 10/1941 | Sweeney | 37/12 |
| 2,312,851 | 3/1943 | Seibert | 37/12 |
| 2,658,984 | 11/1953 | Mohn | 219/354 |
| 3,141,086 | 7/1964 | Prager | 219/220 |
| 3,240,915 | 3/1966 | Carter et al. | 219/354 X |
| 3,445,662 | 5/1969 | Langley | 219/354 X |
| 3,471,681 | 10/1969 | Miller | 219/202 X |
| 3,546,427 | 12/1970 | Farrell, Jr. | 219/220 |
| 3,619,555 | 11/1971 | Bassett, Jr. | 219/202 |
| 3,627,989 | 12/1971 | Heidler et al. | 219/354 X |
| 3,763,348 | 10/1973 | Costello | 219/354 X |

*Primary Examiner*—E. H. Eickholt
*Attorney, Agent, or Firm*—Larson, Taylor and Hinds

[57] ABSTRACT

A method of freeing a coating of ice, snow or frost frozen on to the surface of a manufactured material, such as a metal partition, a masonry or painted structure, or a paved roadway or runway, by concentrating an intense beam of visible light on to the interface between the coating and the surface adequate to raise the temperature at the interfacial zone to the melting point so as to free the coating from the surface, and apparatus for carrying out this method. The apparatus preferably includes structure for immediately breaking and removing the coating.

13 Claims, 6 Drawing Figures

Figure 1:
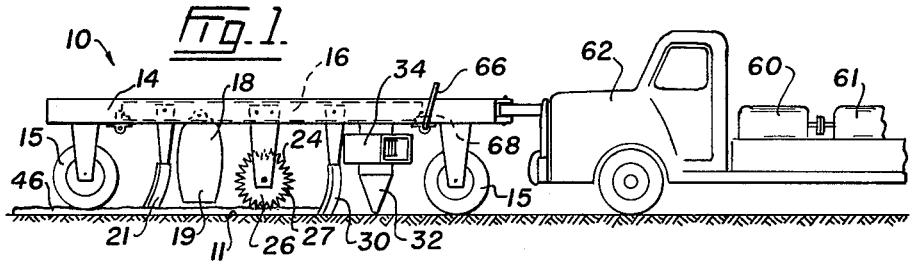

10
14
18
16
34
66
62
60
61
15
24
68
46
15
21
19
11
26
27
30
32

14
18
27
24
16
10
15
21
15
4
35
34
34
3
3
15
4
35
15
26
30
68
66

40
18
48
44

19
46
11
42

18
19
40
40
46
11

18
52
55
54
19
46
11

18
52
52
19
46
11

METHOD AND APPARATUS FOR DETACHING COATINGS FROZEN ON TO SURFACES

This is a continuation of application Ser. No. 321,721, filed Jan. 8, 1973, now abandoned.

It is well known that the adhesive forces between ice and other common materials exceed the internal cohesive strength of ice itself. Attempts to break ice off a surface onto which it is frozen usually result in breaking of the ice but not in completely dislodging it.

Ice in its various forms can be annoying or detrimental under many circumstances and much effort has been expended in its control, and in attempts to find methods by which it may be removed from manufactured surfaces on which it has formed.

Among the methods of ice removal that have been attempted most frequently without success is the use of infra-red radiation, more commonly called radiant heat. This radiant heat does not penetrate the ice more than a few thousandths of an inch, so it melts the ice surface forming a film of water which will remain if the surface is horizontal or drain downward if the surface slopes. Radiant heat does not penetrate water, hence a thin film of water over the ice will prevent any further heat from reaching the ice directly and the melting rate will be reduced accordingly. At best radiant heat, for example from heat lamps, can remove ice only by melting it which is a slow and costly method, leaving substantial amounts of melt water with resulting refreezing problems.

The apparatus illustrated in U.S. Pat. No. 3,471,681, dated Oct. 7, 1969, is an example in which radiant heat is used to melt ice. A bank of heating lamps is provided to heat the surface by radiation, this bank being located behind a blower for directing hot air on to the surface. However, this is subject to the disadvantages pointed out above.

The present invention contemplates a novel technique or method by which the bond between ice and most common surfaces can be disrupted, and apparatus for this purpose. The invention is described herein in connection with the removal of ice from a highway surface, but it is not limited to this application. For example, the method can also be useful for airport runways, pedestrain walkways, ramps, loading docks and marshalling yards, in cold storage and frozen food industries, and for like applications for dislodging accumulations of snow, ice, or frost.

A method according to the present invention comprises concentrating an intense beam of visible light on the interface between a coating of ice, snow or frost, and a surface on which the coating is frozen to transport energy through the frozen coating to the interface at a rate adequate to heat the interfacial zone to a temperature above the freezing point of water, thereby disrupting the bond between the coating and the surface to detach the former from the latter.

When energy is supplied to the interface between two materials, in this case in the form of light which passes relatively unimpeded through ice, snow and frost, but converts to heat on reaching an opaque, absorbing material at the interface, the temperature at the interface rises. The rate of temperature rise is dependent both on the amount of energy supplied to the interface and on the rate at which the energy is provided. In disrupting the bond between frozen water and another material, such as a road surface, the temperature rise at the interface must result in bringing the interface temperature at least to the melting point of ice. Either a low rate of energy supply for a long time or a greater rate for a shorter time can accomplish the desired result. However, as a result of heat conduction away from the interfacial zone, the total energy required to produce the needed increase in temperature is inversely proportional to the rate of energy supply. The present method utilizes a very intense light source, preferably with optical focussing accessories.

One method according to this invention of supplying the energy makes use of light in the wavelength range of 300 to 700 nanometers. This light passes most readily through frozen water in its various common forms and is largely absorbed by and therefore heats opaque base materials from which the frozen coating is to be removed. It has been calculated from laboratory tests on asphaltic concrete pavement that a light beam energy of 40 kilowatts per foot of pavement lane width will provide adequate interfacial melting for a clearance rate of 15 miles per hour when the pavement is not colder than 5°F. The amount of energy required depends upon the temperature of the surface and the speed of movement of the energy source over that surface.

The method of disrupting the bond of the ice at the interface by a supply of energy at a very rapid rate results in operating economy since total energy supply is minimized. A consequence of this procedure is rapid refreezing since very little excess heating results beyond that necessary to melt a thin film at the interface. As a result, the frozen overburden layer must be lifted or swept away within a short period of time, something of the order of 5 seconds, after the melting of the interface as the heat from the interfacial zone is rapidly conducted into the surrounding material which has remained below the melting temperature, and very rapid refreezing of the melted film can occur.

This invention contemplates both the method of detaching ice coatings from surfaces and apparatus for carrying out the method. As applied to the problem of removing ice from a highway surface, the apparatus may be an independent unit which is moved by a suitable traction unit, such as a truck, or it may be a self-propelled unit, or it may be mounted on a truck or the like.

Apparatus in accordance with this invention comprises a suitable frame or base, light means on the base for concentrating an intense beam of visible light onto the interface between the coating to be removed and the surface to which the coating is frozen at a rate adequate to heat the interfacial zone to a temperature above the freezing point of water, thereby disrupting the bond between the coating and the surface to detach the former from the latter. For highway clearing, for example, this apparatus or unit may be used with separate snow plowing equipment, but it is preferable to incorporate into this apparatus plow means ahead of the light means for moving snow out of the path thereof. In addition, the apparatus may include means behind the light means for breaking up the coating immediately after the bond thereof has been disrupted, and means for lifting and removing the broken coating. A further refinement is to include vacuum means for sucking up any residual melted water immediately after the removal of the broken coating and before refreezing occurs.

Figure 2:
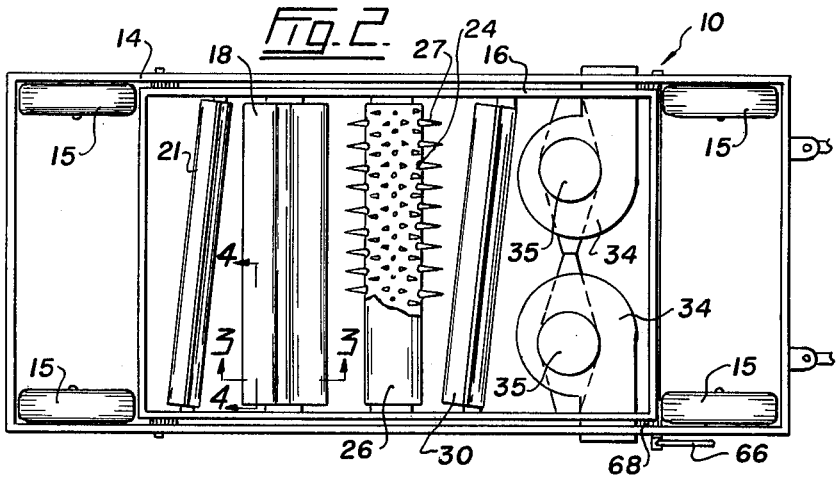
Figure 3:
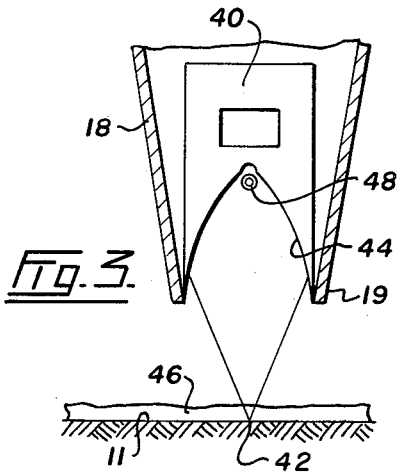
Figure 4:
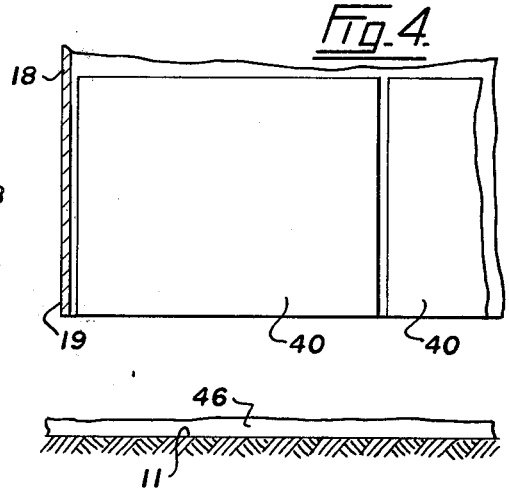
Figure 5:
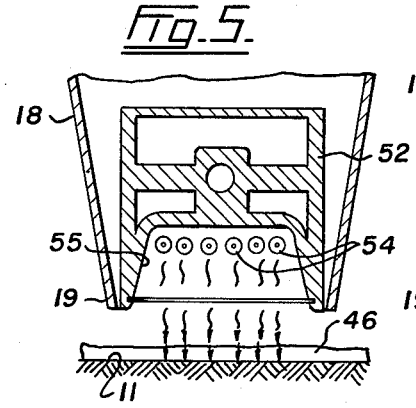
Figure 6:
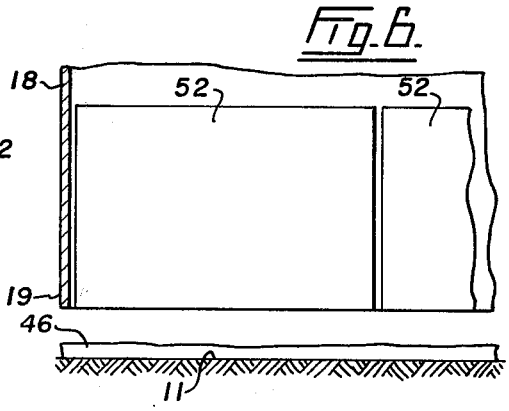

Examples of apparatus in accordance with this invention are diagrammatically illustrated in the accompanying drawings, in which FIG. 1 is a diagrammatic side elevation of one form of the apparatus connected to a truck, FIG. 2 is a plan view of the apparatus, FIG. 3 is a fragmentary cross-section taken on the line 3—3 of FIG. 2, illustrating one source of intense visible light, FIG. 4 is a longitudinal section on the line 4—4 of FIG. 2, FIG. 5 is a fragmentary cross-sectional view similar to FIG. 3, but illustrating a different intense visible light source, and FIG. 6 is a view similar to FIG. 4, but showing the light source of FIG. 5.

Referring to FIGS. 1 to 4 of the drawings, 10 is apparatus in accordance with this invention for freeing coatings, such as ice, snow or frost, from surfaces, such as a road surface 11. Apparatus 10 includes a suitable base frame 14 mounted on wheels 15, although it can be mounted on sleigh runners or tractor-like tracks. Alternatively, the base frame can constitute an extension to an integral part of the frame of a truck, grader or other highway vehicle. A supporting frame 16 is mounted for vertical movement on base frame 14.

A housing 18 is mounted on the supporting frame 16 and is adapted to hold one or more intense light units, said housing having a lower or outlet end 19 which projects downwardly from the frame and terminates just above the road surface 11. Although a snow plow can move ahead of unit 10 to clear away the loose snow from in front of the unit, it is preferable to mount a snow-clearing blade 21 on frame 16 immediately ahead of housing 18, said blade extending transversely of the unit.

A crusher or breaker 24 is mounted on and extends transversely of frame 16 immediately behind housing 18. In the illustrated embodiment, breaker 24 is made up of a roller 26 having spikes 27 radiating from the peripheral surface thereof. If desired, another snow plow blade 30 can be mounted on the supporting frame behind breaker 24.

Although the apparatus described so far is completely operable for the purpose for which it is designed, it is preferable to provide suction means for lifting water from the road surface immediately behind plow 30. A suction nozzle 32 is mounted on frame 16 and extends tranversely thereof behind blade 30, and suction is created in this nozzle by a plurality of suction units 34 carried by the supporting frame and connected to the top of the nozzle, as shown in FIGS. 1 and 2. In this example, suction units 34 are operated by electric motors 35.

FIGS. 3 and 4 illustrate one example of means for producing an intense beam of visible light and directing this onto the surface of road 11. The light beam is produced by a plurality of high-intensity units 40 placed end to end in housing 18 at the lower end 19 thereof. These units are on the market and are well known. Each unit generates a highly concentrated beam along a thin line indicated at 42 in FIG. 3 at the external focal axis of an eliptical reflector 44. The concentrated beam is focused so that line 42 is at the surface of road 11 which is the interface between said road and a layer or coating 46 of ice, snow or frost on the road. The light energy is produced by a tungsten filament enclosed in a clear quartz envelope 48, and 44 is a highly polished aluminum eliptical reflector. This unit 40 is used because of its availability, although it does produce heat which is not required for this invention. In fact, the heat is objectionable since it is applied to the surface of the coating where it creates a useless melting action. If desired, filters can be employed to keep the heat away from the coating. This heat represents wasted energy, and the ideal way is to utilize a unit which produces only an intense beam of visible light.

FIGS. 5 and 6 illustrate an alternative light-producing unit 52 which also is well known and available on the market. This unit includes a plurality of elongated tungsten filament tubular quartz lamps 54 arranged side by side within a reflector 55. This unit provides an intense beam of visible light concentrated at the interface between road 11 and coating 46. Here again, this unit is used because it is readily available. It also produces heat which is not required in this invention, and the light is not as concentrated as it might be. However, the unit could be reconstructed with a reflector that would concentrate the light in somewhat the same manner as is done in unit 40 of FIGS. 3 and 4. As shown in FIG. 6, a plurality of light units 52 are placed end to end within housing 18 at its lower end 19.

Electrical power is provided for the light units and the suction units of apparatus 10 by any suitable means, such as a generator driven by an internal combustion engine. The generator and engine may be mounted on frame 14 or 16 so that apparatus 10 is completely independent, or a generator 60 driven by a motor 61 may be mounted on a truck 62 which is coupled to apparatus 10 to move it along road 11.

Blade 21 is so mounted that it scrapes snow away from in front of housing 18, leaving only a relatively thin coating 46 of ice, snow and/or frost. Breaker 24 is mounted so that its spikes 27 will penetrate into coating 46 without touching the road surface 11, to break said coating into small pieces. Blade 30 is positioned so that it moves along the surface of road 11, lifting and directing the broken coating pieces to one side of the machine. Suction nozzle 32 has its intake end moving just above the surface of road 11 so as to suck up any melted water before it refreezes.

Blades 21 and 30, breaker 24 and nozzle 32 may be mounted on frame 14, in which case they would always maintain the same relation, but it is preferable to mount them on frame 16 so that they can be selectively lowered into their operating position and raised out of said position.

Supporting frame 16 can be raised and lowered relative to base frame 14 in any desired manner. In this example, frame 16 is connected to frame 14 by four cranks, one of which has a lever 66 fixedly connected thereto. This lever can be swung back and forth to raise and lower the supporting frame, and the lever is retained in desired positions by a ratchet arrangement diagrammatically indicated at 68 in FIG. 1.

The operation of apparatus 10 is relatively simple. The apparatus is moved over the road 11 from which the ice coating is to be removed. Blade 21 scrapes away snow down to the coating 42, which is usually ice, and as housing 18 moves over this coating, an intense beam of visible light is concentrated onto the interface between the surface of road 11 and coating 46. The light beam passes relatively unimpeded through the coating of ice, snow and/or frost, but converts to heat on reaching the opaque, absorbing road surface at the interface so that the temperature at the interface rises to disrupt the bond between the frozen water and the road surface. Breaker 24 immediately breaks up the coating that has been freed from the surface, and blade 30 lifts and scrapes the coating particles off to one side of the road. If there is any free water remaining on the road surface, most of it is sucked up by nozzle 32 before it refreezes.

As stated above, a roadway can be relatively rapidly cleared of ice, snow or frost adhering to the surface thereof. In heavy snow falls, it may be necessary to run an ordinary snowplow ahead of apparatus 10. Up to the present time, snow has been regularly cleared from the roads and streets during and after a snowfall, but the standard snowplows cannot remove ice, snow or frost that adheres directly to the road surface. The present apparatus can be moved along the roads at a reasonable speed to break the interfacial bond so that the ice, snow and/or frost can be removed therefrom.

I claim:

1. The method of freeing a coating of ice, snow or frost from a surface to which said coating is frozen, which comprises providing an artificial source of radiant energy which produces an intense beam consisting of radiant energy primarily in the visible light range so that the beam can pass relatively unimpeded through said coating and focussing said beam produced by said source on the interface between said coating and said surface while moving said beam over said surface to transport energy through the frozen coating to the interface such as to heat the surface to raise the temperature of the interface above the freezing point of water to thereby disrupt the bond between the coating and the surface to detach the latter from the former, while substantially all of the material of said coating apart from that at said interface remains below its melting temperature.

2. The method as claimed in claim 1 including the further step of removing said coating from said surface over areas where said bond has been disrupted.

3. The method as claimed in claim 1 in which said visible light has a wavelength range of from about 300 to about 700 nanometers.

4. The method as claimed in claim 1 in which the light beam energy is used at the rate of about 40 kilowatts per foot of surface width at a rate of movement over the surface of about 15 miles per hour.

5. The method as claimed in claim 1 including breaking up the coating immediately after the bond thereof has been disrupted.

6. The method as claimed in claim 5 including lifting and removing the broken coating.

7. The method as claimed in claim 6 including sucking up any residual melted water immediately after the removal of the broken coating and before refreezing occurs.

8. Apparatus for freeing a coating of ice, snow or frost from a surface to which said coating is frozen, comprising a frame to be moved over the coated surface, artificial light means mounted on the frame for producing an intense light beam consisting of light energy primarily in the visible range so that said light beam will pass relatively unimpeded through said coating, means for focussing said light beam on to the interface between the coating and the surface, during motion of said apparatus over said surface, such as to heat the surface to raise the temperature of the interface above the freezing point of water and thereby disrupt the bond between the coating and the surface to detach the former from the latter while substantially all of the material of said coating apart from that at said interface remains below its melting temperature, and means for moving said apparatus over said surface.

9. Apparatus according to claim 8 further comprising means for removing said coating from said surface over areas where said bond has been disrupted.

10. Apparatus as claimed in claim 8 including means on the frame ahead of the light means operable to plow snow away from the light means.

11. Apparatus as claimed in claim 8 including means on the frame behind the light means for breaking up the coating immediately after the bond thereof has been disrupted.

12. Apparatus as claimed in claim 11 including means on the frame for lifting and removing the broken coating.

13. Apparatus as claimed in claim 12 including vacuum means for sucking up any residual melted water immediately after the removal of the broken coating and before refreezing occurs.

* * * * *